US009937411B2

(12) United States Patent
Okuaki et al.

(10) Patent No.: US 9,937,411 B2
(45) **Date of Patent: *Apr. 10, 2018**

(54) BALL LOTTERY APPARATUS

(75) Inventors: Masato Okuaki, Minato-ku (JP); Takashi Uchiyama, Minato-ku (JP); Makoto Nakano, Minato-ku (JP); Shogo Azuma, Minato-ku (JP); Norifumi Kawai, Minato-ku (JP)

(73) Assignee: KONAMI GAMING, INC., Las Vegas, NV (US)

( * ) Notice: Subject to any disclaimer, the term of this patent is extended or adjusted under 35 U.S.C. 154(b) by 331 days.

This patent is subject to a terminal disclaimer.

(21) Appl. No.: 13/814,107

(22) PCT Filed: Aug. 30, 2011

(86) PCT No.: PCT/JP2011/069522
§ 371 (c)(1),
(2), (4) Date: Feb. 4, 2013

(87) PCT Pub. No.: WO2012/029740
PCT Pub. Date: Mar. 8, 2012

(65) Prior Publication Data

US 2013/0134672 A1 May 30, 2013

(30) Foreign Application Priority Data

Sep. 1, 2010 (JP) ..... 2010-195660

(51) Int. Cl.
*A63F 7/04* (2006.01)
*A63F 3/06* (2006.01)
(Continued)

(52) U.S. Cl.
CPC ..... *A63F 3/061* (2013.01); *A63F 3/06* (2013.01); *A63F 5/00* (2013.01); *A63F 5/02* (2013.01);
(Continued)

(58) Field of Classification Search
CPC ..... A63F 7/04; A63F 9/00; G07C 15/00
(Continued)

(56) References Cited

U.S. PATENT DOCUMENTS 4,757,999 A * 7/1988 Opresco ..... 273/145 CA
4,778,182 A * 10/1988 Brignole ..... 273/144 A
(Continued)

FOREIGN PATENT DOCUMENTS

CN 1218707 A 6/1999
CN 1743036 A 3/2006
(Continued)

OTHER PUBLICATIONS

Office Action, dated Apr. 15, 2014, issued by the State Intellectual Property Office of the People's Republic of China, in counterpart Application No. 201180042200.8.

*Primary Examiner* — John E Simms, Jr.
*Assistant Examiner* — Dolores Collins
(74) *Attorney, Agent, or Firm* — Sughrue Mion, PLLC

(57) ABSTRACT

A ball lottery apparatus include a discharger adapted for discharging individually multiple lottery balls, a lottery field including multiple holes in which the discharged lottery balls can enter, a host controller for executing various controls, a retrieval mechanism adapted for retrieving the lottery balls. When a bingo game is played, the host controller can set the ball lottery apparatus to a normal mode in which an input time point at which each of the lottery balls discharged from the discharger is input to the lottery field depends on a predetermined rule, and to a dealer mode in which the input time point depends on human action.

9 Claims, 7 Drawing Sheets

(51) Int. Cl.
*A63F 5/00* (2006.01)
*A63F 5/02* (2006.01)
*G07F 17/32* (2006.01)

(52) U.S. Cl.
CPC ..... *G07F 17/3202* (2013.01); *G07F 17/3216* (2013.01); *G07F 17/329* (2013.01)

(58) Field of Classification Search
USPC ..... 273/138.2, 144 A
See application file for complete search history.

(56) References Cited

U.S. PATENT DOCUMENTS 4,877,246 A * 10/1989 Kropkowski ..... 273/144 R
5,178,395 A * 1/1993 Lovell ..... 463/22
5,443,179 A * 8/1995 Palmer et al. ..... 221/265
5,452,822 A * 9/1995 Haymond ..... 221/155
5,590,879 A * 1/1997 Tripp ..... 273/144 R
5,811,683 A * 9/1998 Yoshioka et al. ..... 73/660
6,164,646 A 12/2000 Uehara et al.
6,416,053 B1 * 7/2002 Kamimura ..... 273/121 B
6,551,183 B2 * 4/2003 Knox et al. ..... 453/18
6,641,137 B2 * 11/2003 Sines et al. ..... 273/121 B
6,764,396 B2 * 7/2004 Seelig et al. ..... 463/17
D499,146 S * 11/2004 Liu et al. ..... D20/7
6,817,945 B2 * 11/2004 Seelig et al. ..... 463/20
6,824,463 B1 11/2004 Yamaguchi et al.
7,396,013 B2 * 7/2008 Ito et al. ..... 273/269
7,547,018 B2 * 6/2009 Lin ..... 273/144 A
7,572,185 B2 * 8/2009 Seelig et al. ..... 463/32
7,674,172 B2 * 3/2010 Miltenberger et al. ..... 463/17
D621,179 S * 8/2010 Biraghi ..... D6/450
7,766,145 B1 * 8/2010 Chang ..... 193/13
7,780,524 B2 * 8/2010 Kobayashi ..... 463/29
8,141,521 B2 * 3/2012 Shatoff et al. ..... 119/707
8,257,181 B2 * 9/2012 Shimizu ..... 463/46
8,292,721 B1 * 10/2012 Watanabe
8,306,697 B2 * 11/2012 Lu et al. ..... 701/38
8,342,232 B2 * 1/2013 Shikine et al. ..... 164/454
8,394,266 B2 * 3/2013 Pichon et al. ..... 210/167.16
8,413,557 B2 * 4/2013 Akiyama et al. ..... 82/118
8,424,427 B2 * 4/2013 Akiyama et al. ..... 82/1.11
8,573,594 B2 * 11/2013 Watanabe ..... 273/138.3
2006/0046837 A1 3/2006 Ito et al.
2007/0075488 A1 * 4/2007 Pececnik ..... 273/138.1
2008/0176622 A1 7/2008 Okada
2009/0082086 A1 * 3/2009 Seelig et al. ..... 463/20
2011/0210509 A1 * 9/2011 Okuaki ..... 273/138.2
2012/0298687 A1 * 11/2012 Yeung ..... 221/155
2013/0134672 A1 * 5/2013 Okuaki et al. ..... 273/144 A

FOREIGN PATENT DOCUMENTS

JP 8-033753 A 2/1996
JP 2004-089514 A 3/2004
JP 2005-080690 A 3/2005
JP 2008-173477 A 7/2008
JP 2009-055991 A 3/2009
JP 2009-189546 A 8/2009
JP 2010-119662 A 6/2010
TW M293066 U 7/2006

* cited by examiner

BALL LOTTERY APPARATUS

CROSS REFERENCE TO RELATED APPLICATIONS

This application is a National Stage of International Application No. PCT/JP2011/069522 filed Aug. 30, 2011, claiming priority based on Japanese Patent Application No. 2010-195660, filed Sep. 1, 2010, the contents of all of which are incorporated herein by reference in their entirety.

FIELD OF THE INVENTION

The present invention relates to a ball lottery apparatus for offering a drawing by the use of multiple balls.

BACKGROUND ART

For example, Patent Document 1 discloses a lottery apparatus including a field on which input lottery balls roll, and a roulette section having multiple pockets into which the lottery balls may drop. When the ball lottery apparatus offers a drawing, multiple lottery balls are input to the field and the lottery result is decided depending on which pockets the input lottery balls enter.

Patent Document 1: JP-A-2004-89514

SUMMARY OF THE INVENTION

However, in conventional ball lottery apparatuses, balls are input to the roulette section only automatically.

The present invention provides a ball lottery apparatus in which a person can input the lottery balls.

A ball lottery apparatus according to the present invention includes a discharger adapted for discharging individually multiple lottery balls that are used for a lottery; a lottery field including multiple holes where the lottery balls discharged from the discharger can enter; a lottery result decider adapted for deciding a lottery result depending on which lottery holes where the lottery balls have entered; a retrieval mechanism adapted for retrieving the lottery balls that have entered the holes; and a mode setter adapted for setting the ball lottery apparatus to a first mode in which an input time point at which each of the lottery balls discharged from the discharger is input to the lottery field (the time point at which the lottery ball begins to roll on the lottery field) depends on a predetermined rule, and to a second mode in which the input time point depends on human action.

In accordance with the present invention, the time points at which multiple lottery balls used in a single lottery are input to the lottery field (the input time points) depend on human action of a person, for example, a game facility staff member or a player in the second mode. In other words, in accordance with the present invention, there is provided a ball lottery apparatus in which a lottery is performed with the intervention of human manipulation. In summary, a person can input the lottery balls in a lottery.

If the ball lottery apparatus includes a carrier mechanism adapted for carrying the multiple lottery balls retrieved by the retrieval mechanism to the discharger, the multiple lottery balls can be used for a plurality of lotteries repeatedly. The ball lottery apparatus may include a first reservoir adapted for reserving the lottery balls of which the total number is at least the total number of the lottery balls used in a single lottery. Alternatively, the carrier may have a function to reserve the multiple lottery balls retrieved by the retrieval mechanism.

An aspect of the ball lottery apparatus may further include a rail configured to guide the lottery balls discharged from the discharger to the lottery field; a blocking member configured to be set to a first status in which the lottery balls passing through the rail are permitted to be guided to the lottery field, and to a second status in which the lottery balls passing through the rail are blocked and are prevented from being guided to the lottery field; and a discharge controller adapted for controlling a discharge time point at which each of the lottery balls are discharged (launched) from the discharger, in which the mode setter may be configured to set the blocking member to the first status in the first mode, and to set the blocking member to the second status in the second mode. In this aspect, in the second mode, the blocking member is set to the second status, so that the lottery balls discharged from the discharger and passing through the rail are blocked from being directed to the lottery field and are temporarily held, whereby the lottery balls can be taken out by a person. Therefore, a person can take out the lottery balls blocked from moving to the lottery field and temporarily held, and can throw them onto the lottery field. In other words, the input time point in the second mode depends on the throw-in activity that a person, for example, a game facility staff member or a player, throws the lottery balls that have been blocked from moving. Thus, the lottery is made with intervention of human manipulation. The place for temporarily holding the lottery balls blocked from moving to the lottery field by the blocking member can be decided freely. For example, lottery balls may be held on the rail. Alternatively, for example, a second reservoir may be located outside the lottery field, and this second reservoir may hold the lottery balls, whereby the lottery balls can be taken out by a person. In this alternation, the route of lottery balls discharged from the discharger and passing through the rail is switched by the blocking member, so that the lottery balls are not directed to lottery field and are directed to and temporarily held in the second reservoir.

The ball lottery apparatus may further include an abnormality detector adapted for determining that an abnormality has occurred if no lottery ball has entered any of the multiple holes within a predetermined decision period after discharging a lottery ball from the discharger, in which the predetermined decision period in the second mode may be set longer than that in the first mode. Whereas lottery balls discharged from the discharger are directly guided to the lottery field in the first mode, lottery balls discharged from the discharger are blocked from moving and then thrown into the lottery field by a person in the second mode. Therefore, in the second mode, the time length from discharging a lottery ball from the discharger to the entry of the lottery ball into one of the multiple holes is longer than that in the first mode. Accordingly, if the decision period for the time-out abnormality decision in the second mode is the same as that in the first mode, the progress of the game may be frequently blocked in the second mode by the decision that a time-out abnormality has occurred. In this aspect of the invention, since the decision period in the second mode is set longer than that in the first mode, occurrence of errors in the dealer mode is restricted, whereby the game can be advanced properly.

The abovementioned abnormality detector may be adapted for executing the abnormality decision in the first mode and for not executing the abnormality decision in the second mode. In this aspect, time-out errors do not occur in the second mode, so that it is possible to properly advance the game without an unnecessary abnormality decision.

An aspect of the ball lottery apparatus may further include a manipulation acceptor configured to accept the human action, in which the mode setter may include a discharge controller adapted for controlling a discharge time point at which each of the lottery balls are discharged from the discharger, and in which the discharge controller may be adapted to control the discharge time point depending on the predetermined rule in the first mode, and to control the discharge time point depending on a time point at which the manipulation acceptor accepts the human action in the second mode. In this aspect, the input time point depends on the time point at which the manipulation acceptor accepts the manipulation by the person, such as a game facility staff member or a player. Accordingly, the person can adjust the input time points of lottery balls.

If a predetermined requirement is satisfied in the first mode, the mode setter may be adapted for switching the ball lottery apparatus to the second mode directly after finishing the decision of the lottery result made by the lottery result decider in the first mode. In this aspect, switching from the first mode to the second mode is executed seamlessly.

DESCRIPTION OF EMBODIMENTS

A. First Embodiment

Figure 1:
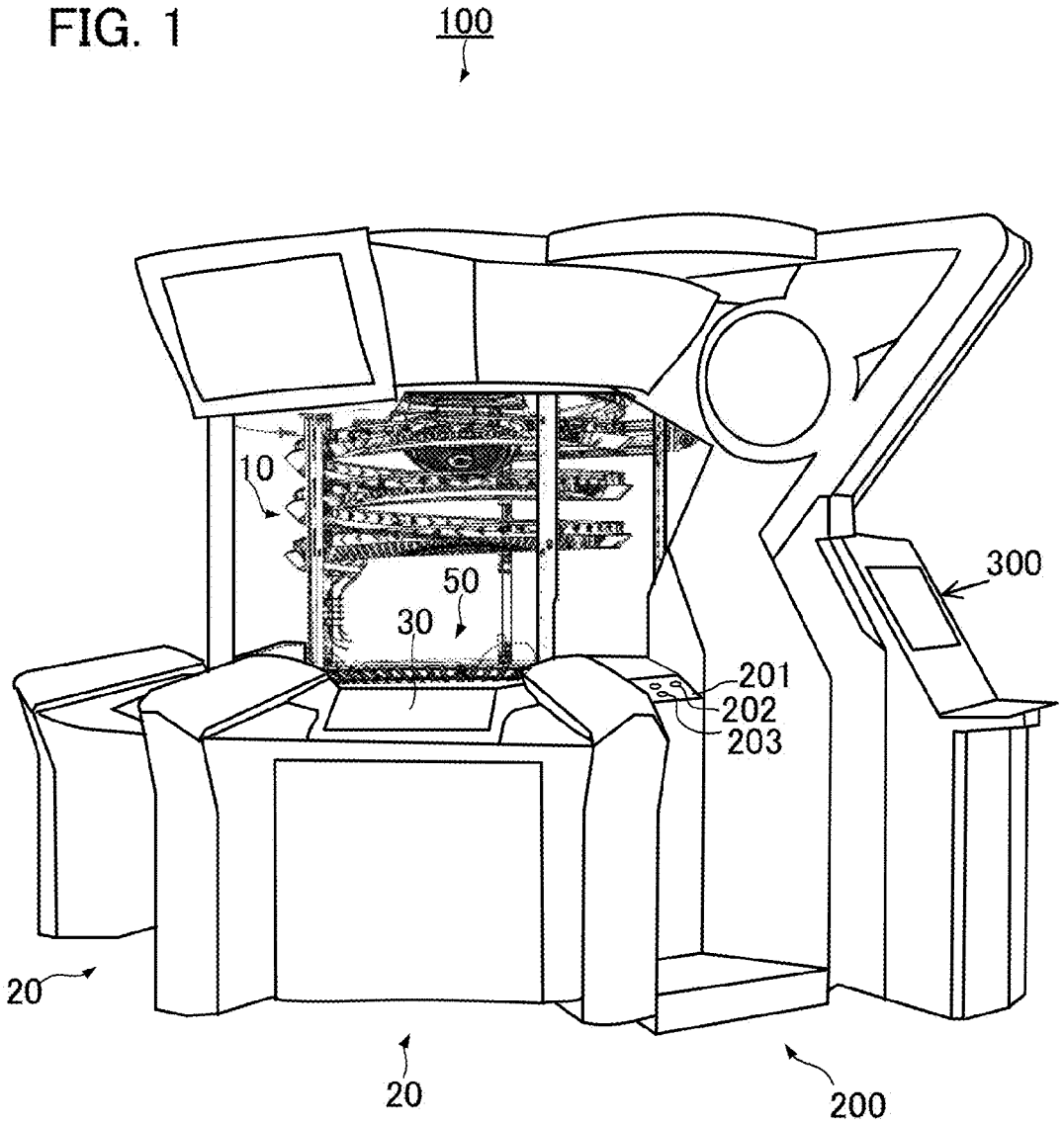
FIG. 1 is a view showing the appearance of a game apparatus according to an embodiment of the present invention.

FIG. 1 is a view showing the appearance of a game apparatus 100 according to an embodiment of the present invention. The game apparatus 100 offers a bingo game that is an example of a ball lottery game. As shown in FIG. 1, the game apparatus 100 includes a ball lottery apparatus 10, multiple stations 20 arranged to surround the ball lottery apparatus 10, and a dealer station 200. The game apparatus 100 includes a credit deposit terminal 300 where players deposit credits, but this will not be explained in detail.

In each station 20, a single player plays the game. Each station 20 includes a coin slot (not shown) into which the player drops token coins (that may also be called "medals"), and a display unit 30 showing images corresponding to progress of the game. In this embodiment, the display unit 30 is formed of a liquid crystal touch panel, and it can serve as a manipulation section at which the player conducts manipulation with respect to the game. In this embodiment, a player plays the game at each single station, but the present invention is not limited to this embodiment, and multiple players may play the game in each single station 20. Furthermore, the number of the stations 20 may be freely selected.

In the dealer station 200, a dealer, e.g., a game facility staff member, may conduct various settings and manipulations. The dealer station 200 includes a manipulation acceptor 201 configured for accepting various manipulations that includes various manipulation buttons 202 and 203.

Figure 2:
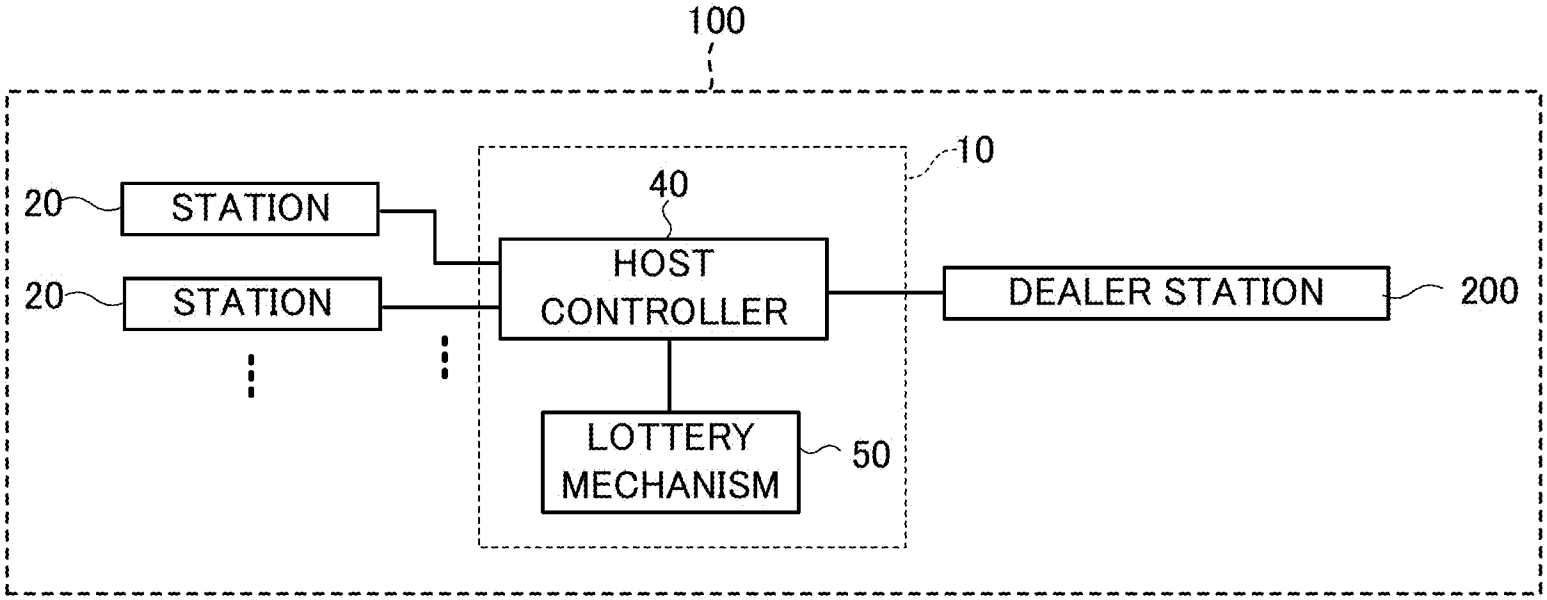
FIG. 2 is a block diagram showing the outline of a control system of the game apparatus.

FIG. 2 is a block diagram showing the outline of a control system of the game apparatus 100. The ball lottery apparatus 10 includes a host controller 40 and a lottery mechanism 50 that will be described later. The host controller 40 is a computer that controls the overall game apparatus 100 including the lottery mechanism 50, the multiple stations 20, and the dealer station 200.

Figure 3:
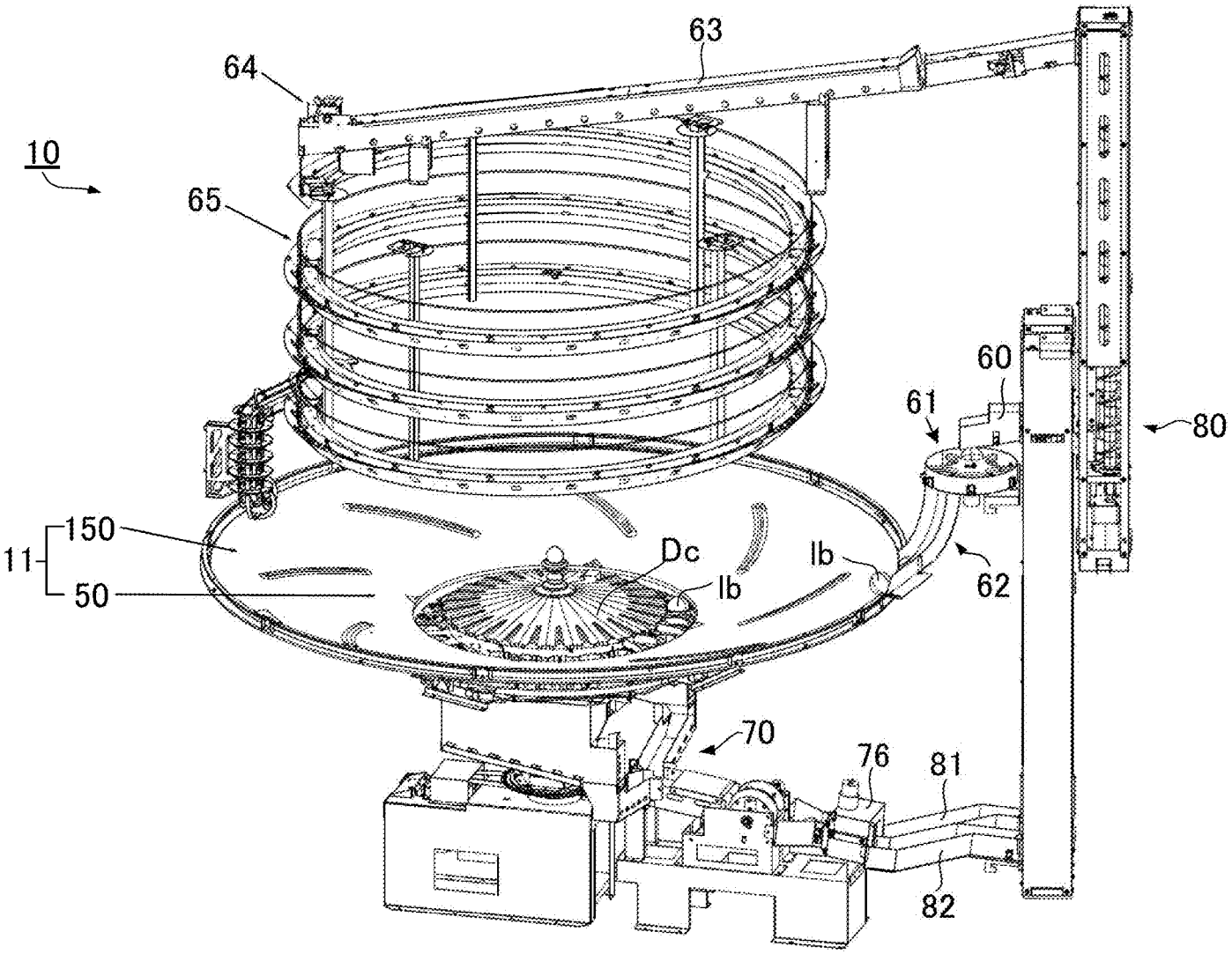
FIG. 3 is a perspective view showing a detailed structure of a ball lottery apparatus in the game apparatus.

FIG. 3 is a perspective view showing a detailed structure of a ball lottery apparatus 10. In FIG. 3, illustration of other elements in the game apparatus 100, e.g., the stations, is omitted. As shown in FIG. 3, the ball lottery apparatus 10 includes a field 150 on which multiple lottery balls 1*b* can roll, and a lottery mechanism 50 including a roulette section in which multiple lottery pockets are formed so that the lottery balls 1*b* may enter the lottery pockets. Furthermore, the ball lottery apparatus 10 includes a first reservoir 60 capable of storing multiple lottery balls 1*b* used for the bingo game that will be described later, a first discharger 61 capable of discharging the multiple lottery balls 1*b* stored in the first reservoir 60 individually (one by one) from the first reservoir 60, and a first rail 62 capable of guiding the lottery balls 1*b* discharged by the first discharger 61 onto the field 150. Furthermore, the ball lottery apparatus 10 includes a special game reservoir 63 for storing multiple lottery balls 1*b* used for a special game that will be described later, a second discharger 64 capable of discharging the multiple lottery balls 1*b* stored in the special game reservoir 63 individually (one by one) from the special game reservoir 63, and a second rail 65 of a spiral shape for guiding the lottery balls 1*b* discharged by the second discharger 64 into a lottery field 11. Furthermore, the ball lottery apparatus 10 includes a retrieval mechanism 70 for retrieving the lottery balls 1*b* that have entered the lottery pockets, a route switcher 76 for switching a route for carrying the lottery balls 1*b* out of the retrieval mechanism 70 to a first partition line 81 directed to the first reservoir 60 or to a second partition line 82 directed to the special game reservoir 63, and a carrier mechanism 80 for carrying the lottery balls 1*b* that have been retrieved by the retrieval mechanism 70 to the first reservoir 60 or special game reservoir 63. In this specification, the combination of the upper surface of the field 150 and the upper surface of the lottery mechanism 50 is referred to as "lottery field 11". Since the lottery mechanism 50 includes a roulette section where the lottery pockets are formed, the lottery field 11 can be considered to have multiple holes (lottery pockets) where the multiple lottery balls 1*b* may enter.

Figure 4:
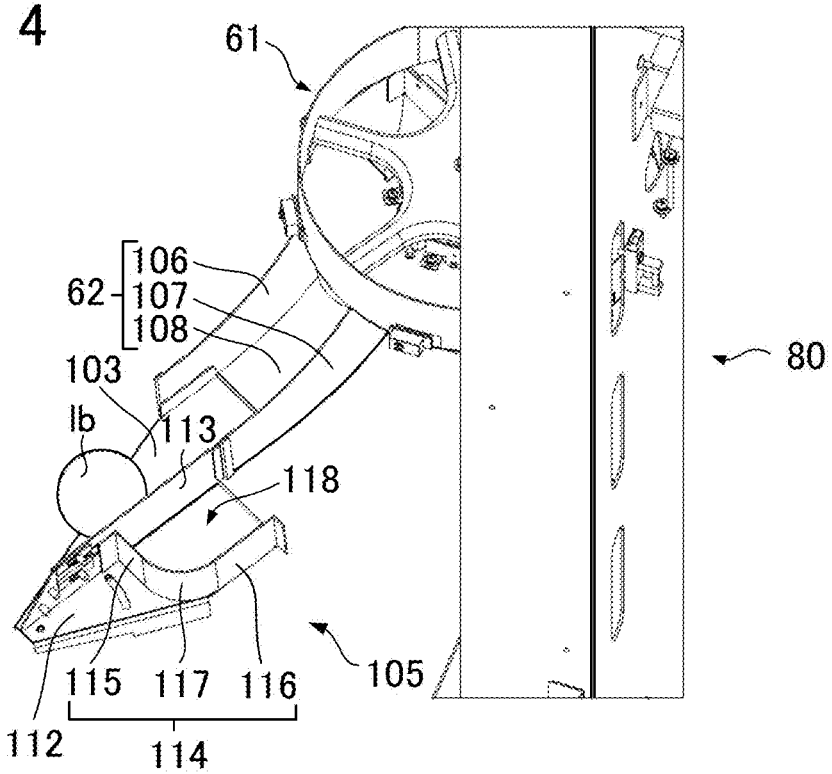
FIG. 4 is a perspective view showing a first rail and a blocking member that is in a first status of the ball lottery apparatus.
Figure 5:
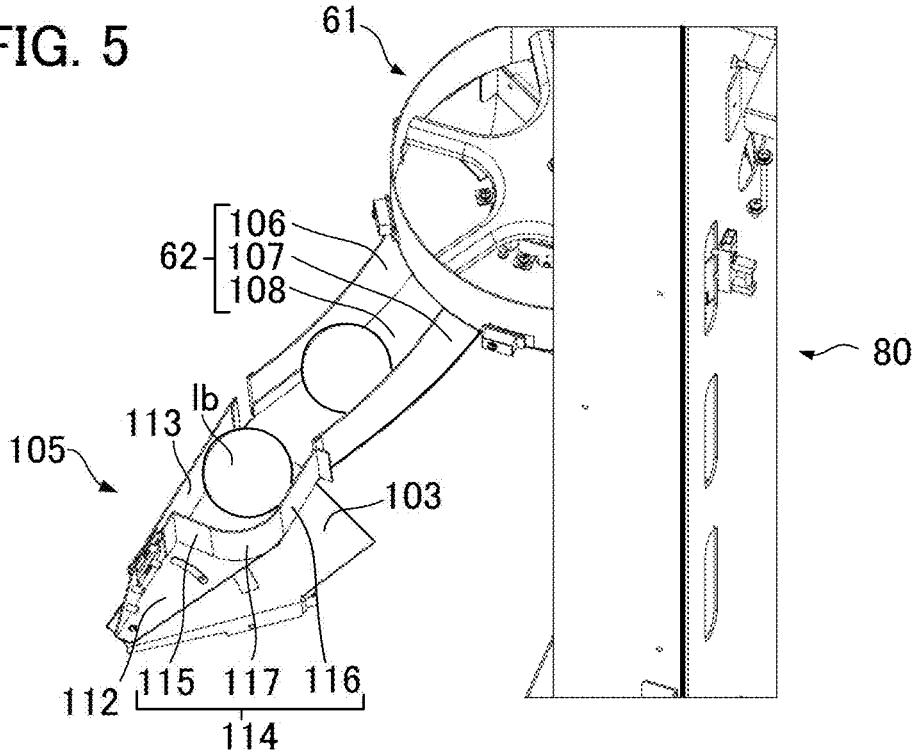
FIG. 5 is a perspective view showing the first rail and the blocking member that is in a second status of the ball lottery apparatus.

As shown in FIGS. 4 and 5, the first rail 62 includes a pair of side walls (right side wall 106 and left side wall 107) and a bottom plate 108. A plate-like base member 103 is coupled to the bottom plate 108. On the base member 103, a blocking member 105 is provided for blocking the lottery balls 1*b* passing through the first rail 62.

As shown in FIGS. 4 and 5, the blocking member 105 includes a bottom plate 112, a side wall 113 rising up from the side edge of the bottom plate 112, and a blocking plate 114 that partitions the space above the bottom plate 112 and can block the movement of the lottery balls 1*b*. An end of the blocking plate 114 is connected to the middle portion of the side wall 113. When viewed from the direction vertical to the bottom plate 112, the blocking plate 114 is generally of an L shape. As shown in FIGS. 4 and 5, the blocking plate 114 consists of a first part 115 extending from the middle portion of the side wall 113 vertically to the longitudinal direction of the side wall 113, a second part 116 extending in parallel to the longitudinal direction of the side wall 113, and a curved part 117 connecting the first part 115 and the second part 116. The interval between the side wall 113 and the second part 116 is generally the same as the width of the first rail 62 (the interval between the right side wall 106 and the left side wall 107). In this specification, the portion surrounded by the bottom plate 112, the side wall 113, and the blocking plate 114 is referred to as "second reservoir 118". The second reservoir 118 is located outside of the lottery field 11, and stores the lottery balls 1*b* of which movement is blocked in such a manner that the lottery balls 1*b* can be extracted by people. In this embodiment, a dealer (for example, a game facility staff member) who is a human in the dealer station can extract the lottery balls 1*b* reserved in the second reservoir 118 (lottery balls 1*b* of which movement is blocked).

The blocking member 105 is coupled to the base member 103 via a pivot shaft (detailed illustration is omitted) that is located near the cusp of the bottom plate 112. Under control of the host controller 40, the blocking member 105 can pivot about the pivot shaft, whereby the relative position of the blocking member 105 can vary with respect to the base member 103. In this embodiment, as shown in FIG. 4, when the position of the blocking member 105 is set so that the side wall 113 of the blocking member 105 is aligned with the left side wall 107 of the first rail 62, the lottery balls 1*b* passing through the first rail 62 are guided to the lottery field 11, not to the second reservoir 118 (first status). That is to say, in the first status, the movement of the lottery balls 1*b* passing through the first rail 62 is not obstructed, so that the lottery balls 1*b* are guided to the lottery field 11. As shown in FIG. 5, when the position of the blocking member 105 is set so that the side wall 113 of the blocking member 105 is aligned with the right side wall 106 of the first rail 62 and that the blocking plate 114 of the blocking member 105 is aligned with the left side wall 107 of the first rail 62, the lottery balls 1*b* passing through the first rail 62 are not guided to the lottery field 11 and are held in the second reservoir 118 (second status). That is to say, in the second status, the movement of the lottery balls 1*b* passing through the first rail 62 is obstructed, so that the lottery balls 1*b* are not guided to the lottery field 11. Switching between the first status and the second status can be made under the control of the host controller 40, but may be made manually instead of control by the host controller 40.

As will be described later, in this embodiment, the ball lottery apparatus 10 can be switched from a "normal mode" (the first mode) in which the bingo game is advanced without human intervention to a "dealer mode" (the second mode) in which the bingo game is advanced with human intervention. In the normal mode, the host controller 40 (mode setter) controls the position of the blocking member 105, so that the movement of the lottery balls 1*b* passing through the first rail 62 is not blocked and the lottery balls 1*b* are directed to the lottery field 11. More specifically, as shown in FIG. 4, the host controller 40 controls the position of the blocking member 105 so that the side wall 113 of the blocking member 105 is aligned with the left side wall 107 of the first rail 62, whereby the lottery balls 1*b* passing through the first rail 62 are directed to the lottery field 11.

In the dealer mode, the host controller 40 (mode setter) controls the position of the blocking member 105, so that the movement of the lottery balls 1*b* passing through the first rail 62 is blocked and the lottery balls are not directed to the lottery field 11. More specifically, as shown in FIG. 5, the host controller 40 controls the position of the blocking member 105 so that the side wall 113 of the blocking member 105 is aligned with the right side wall 106 of the first rail 62 and that the blocking plate 114 of the blocking member 105 is aligned with the left side wall 107 of the first rail 62, whereby the movement of the lottery balls 1*b* passing through the first rail 62 is blocked and the lottery balls 1*b* are not directed to the lottery field 11 and are stored in the second reservoir 118.

Figure 6:
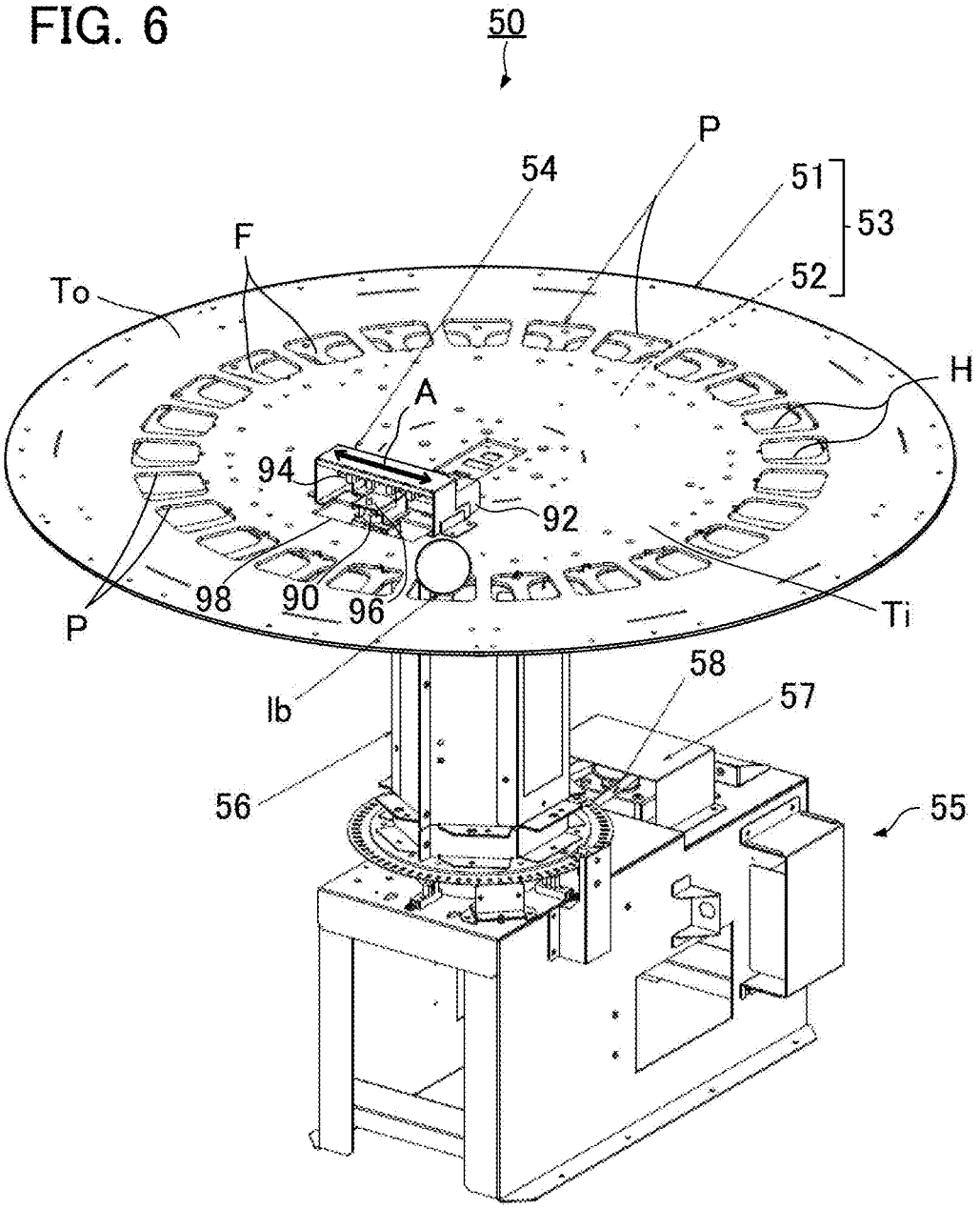
FIG. 6 is a perspective view showing a detailed structure of a lottery mechanism of the ball lottery apparatus when viewed from obliquely above.
Figure 7:
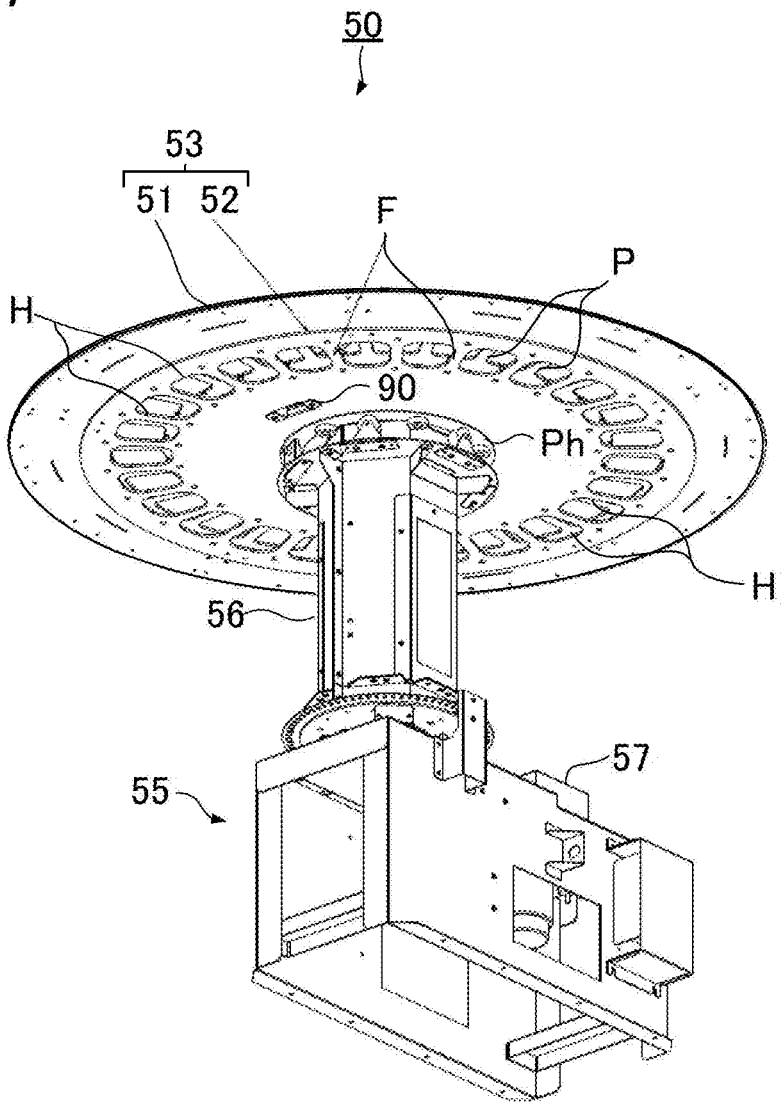
FIG. 7 is a perspective view showing a detailed structure of the lottery mechanism when viewed from obliquely below.

FIGS. 6 and 7 are perspective views showing the detailed structure of the lottery mechanism 50 in which a decorative member Dc shown in FIG. 3 is removed. As shown in FIGS. 6 and 7, the lottery mechanism 50 includes a roulette section 53 in which an upper disposed roulette wheel 51 and a lower disposed retention plate 52 are superposed and are rotatable as a unit, a slide motor unit 54 configured to alter the relative angular position of the retention plate 52 with respect to the roulette wheel 51, and a rotation mechanism 55 for rotating the roulette section 53.

The roulette wheel 51 is a generally circular plate in which multiple lottery pockets P through which the lottery balls 1*b* can pass are formed along a circumferential direction, and the plate is formed so that the more to the interior it is, the lower it is. There are 25 lottery pockets P in all, each of which corresponds to a number among numbers from 1 to 25, and the numbers are assigned to the lottery pockets P in such a manner that the number increases one by one in the clockwise direction. The slide motor unit 54 is mounted on a region Ti of the surface (upper surface) of the roulette wheel 51 surrounded by the multiple lottery pockets P, whereas a decorative member Dc shown in FIG. 3 is placed on the region Ti. Another region To of the surface of the roulette wheel 51 outside the multiple lottery pockets P is located beneath the field 150 and covered with the field 150. The distal end of a shaft 56 included in the rotation mechanism 55 is connected to the center of the reverse side (lower surface) of the roulette wheel 51. In this embodiment, the roulette wheel 51 is supported by the rotation mechanism 55.

The retention plate 52 is located below (at the side of the reverse surface of) the roulette wheel 51. As shown in FIGS. 6 and 7, the retention plate 52 is a generally circular plate in which multiple holes H through which the lottery balls 1*b* can pass are formed along a circumferential direction, the number of the holes H being the same as that of the lottery pockets P. At the center of the retention plate 52, a through-hole Ph is formed. As shown in FIG. 7, flat ribs F are interposed between neighboring holes H. A connection member 90 that protrudes upwardly from the retention plate 52 is provided on the retention plate 52. The retention plate 52 is supported by a support mechanism (not shown) that supports the retention plate 52, but does not support the roulette wheel 51.

As shown in FIG. 6, the above-mentioned slide motor unit 54 includes a slide motor 92, a screw shaft 94 that rotates driven by the slide motor 92, and a sliding member 96 attached to the screw shaft 94. When the slide motor 92 rotates, the screw shaft 94 rotates. By rotation of the screw shaft 94, the sliding member 96 attached to the screw shaft 94 is moved straight along the axial direction of the screw shaft 94. When the slide motor 92 is rotated in reverse, the sliding member 96 is moved in reverse. In FIG. 6, two-headed arrow A indicates the direction of the movement of the sliding member 96.

Furthermore, as shown in FIG. 6, an elongated hole 98 is formed at an area near the screw shaft 94 among the region Ti of the roulette wheel 51. The longitudinal direction of the elongated hole 98 is parallel to the axial direction of the screw shaft 94 (i.e., the movement direction of the sliding member). The above-mentioned connection member 90 affixed to the retention plate 52 penetrates through the elongated hole 98. In addition, the connection member 90 and the sliding member 96 are mutually connected with each other. With the connection member 90 and the sliding member 96 being connected, when the sliding member 96 moves along the longitudinal direction of the elongated hole 98, the retention plate 52 rotates with respect to the roulette wheel 51 by an angle corresponding to the distance of movement of the sliding member 96. That is to say, movement of the sliding member 96 connected to the connection member 90 along the longitudinal direction of the elongated hole 98 causes change in the angular position of the retention plate 52 with respect to the roulette wheel 51.

In this embodiment, when the bingo game is played, the host controller 40 controls the slide motor unit 54 to adjust the angle of the retention plate 52 so that the ribs F interposed between neighboring holes H of the retention plate 52 and the lottery pockets P of the roulette wheel 51 are superposed in order that lottery balls 1*b* entering the lottery pockets P be retained by the ribs F under the lottery pockets P without falling. The status of the roulette section 53 at this time is referred to as a "ball-hold status", and the position of the sliding member 96 at this time is referred to as a "first position".

In this embodiment, when the lottery balls 1*b* having entered the lottery pockets P are retrieved after each bingo game is finished, or when the special game that will be described later is played, the host controller 40 controls the slide motor unit 54 to adjust the angle of the retention plate 52 so that the holes H of the retention plate 52 and the lottery pockets P of the roulette wheel 51 are superposed in order that lottery balls 1*b* having entered the lottery pockets P fall from the lottery pockets through the holes H. The status of the roulette section 53 at this time is referred to as a "ball-through status", and the position of the sliding member 96 at this time is referred to as a "second position".

In order to switch the roulette section 53 from the ball-through status to the ball-hold status, the host controller 40 controls the slide motor unit 54 to move the sliding member 96 from the second position to the first position, whereby the retention plate 52 is revolved counterclockwise with respect to the roulette wheel 51. Once the ribs F interposed between neighboring holes H of the retention plate 52 are positioned under the lottery pockets P of the roulette wheel 51, the host controller 40 stops the rotation of the slide motor unit 54 to stop the revolution of the retention plate 52. On the other hand, in order to switch the roulette section 53 from ball-hold status to the ball-through status, the host controller 40 controls the slide motor unit 54 to move the sliding member 96 from the first position to the second position, whereby the retention plate 52 is revolved clockwise with respect to the roulette wheel 51. Once the holes H of the retention plate 52 are located under the lottery pockets P of the roulette wheel 51, the host controller 40 stops the rotation of the slide motor unit 54 to stop the revolution of the retention plate 52. When the slide motor unit 54 is not driven, the retention plate 52 is not able to move with respect to the roulette wheel 51 since the sliding member 96 and the connection member 90 are securely connected to the screw shaft 94. In this status, when the shaft 56 fixed to the roulette wheel 51 is rotated, the retention plate 52 is rotated together with the roulette wheel 51.

As shown in FIGS. 6 and 7, the above-mentioned rotation mechanism 55 includes a shaft 56, a motor unit 57, and a timing belt 58. The motor unit 57 contains a driving motor (not shown). The rotation of the driving motor is transmitted via the timing belt 58 to the shaft 56, so that the shaft 56 is rotated. The rotation of the shaft 56 causes rotation of the roulette section 53. More specifically, when the shaft 56 is rotated, the roulette wheel 51, the retention plate 52, and the slide motor unit 54 are rotated jointly. In other words, in either of the ball-hold status or the ball-through status, it is possible to rotate the roulette section 53. In addition, during rotation of the roulette section 53, it is possible to switch from the ball-hold status to the ball-through status, and to switch from the ball-through status to the ball-hold status.

The lottery balls 1*b* retrieved by the retrieval mechanism 70 beneath the roulette section 53 are forwarded to the route switcher 76. As shown in FIG. 3, the exit side of the route switcher 76 is bifurcated into the first partition line 81 and the second partition line 82. Under control of the host controller 40, the route switcher 76 switches the route for conveying lottery balls 1*b* to the first partition line 81 or the second partition line 82. The carrier mechanism 80 includes a first carrying line for carrying the lottery balls 1*b* to the first reservoir, and a second carrying line for carrying the lottery balls 1*b* to the special game reservoir 63. The first partition line 81 is communicated with the first carrying line, whereas the second partition line 82 is communicated with the second carrying line.

When the route for carrying the lottery balls 1*b* is switched to the first partition line 81 by the route switcher 76, lottery balls 1*b* are carried to the first partition line 81 and are sent to the first reservoir 60 through the first carrying line of the carrier mechanism 80. When the route for carrying the lottery balls 1*b* is switched to the second partition line 82 by the route switcher 76, lottery balls 1*b* are carried to the second partition line 82 and are sent to the special game reservoir 63 through the second carrying line of the carrier mechanism.

Next, the flow of games performed in the game apparatus 100 will be described in more detail. In this embodiment, two sorts of games including the bingo game and the special game can be performed in the game apparatus 100. The special game is a game started if a predetermined requirement is satisfied and is different from the bingo game.

Figure 8:
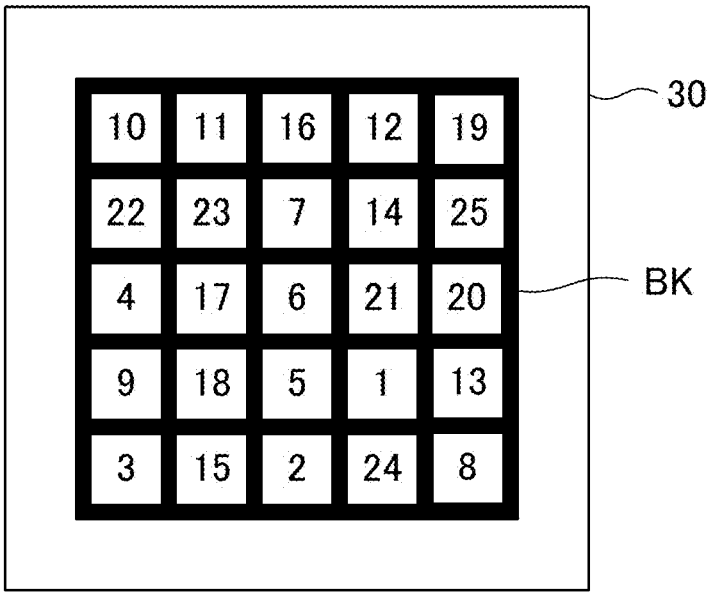
FIG. 8 is a view showing an image of a bingo card displayed on a display unit of the game apparatus.

Aspects of the bingo game will be described. At the initial status at which players start games, the host controller 40 controls the game apparatus 100 to execute the bingo game. In this embodiment, there are provided a "ball-hold mode" and a "ball-through mode" for the roulette section 53. For executing the bingo game, the host controller 40 selects the ball-hold mode and controls the game apparatus 100 according to the ball-hold mode. In the ball-hold mode, the host controller 40 controls the slide motor unit 54 so that the roulette section 53 is in the ball-hold status. Accordingly, when the lottery balls 1*b* enter the lottery pockets P, the lottery balls 1*b* are retained by the roulette section 53 without falling. In addition, the host controller 40 controls the display unit 30 of each station 20 for causing the display unit 30 to show an image of a bingo card BK, an example of which is shown in FIG. 8. The bingo card BK is a card in which numbers from one to 25 are randomly arranged in a matrix of five rows and five columns, and actually it is presented to the players as only an image on the display units 30. The arrangement of the numbers on the bingo card BK is set to vary depending on the station 20 (i.e., the player).

In the ball-hold mode, the host controller 40 (discharge controller) controls the rotation mechanism 55 to rotate the roulette section 53, and controls the first discharger 61 for causing the first discharger 61 to discharge lottery balls 1*b* individually in compliance with a predetermined rule. Thus, the discharge time point at which each individual lottery ball 1*b* is discharged (launched) from the first discharger 61 depends on the predetermined rule. In this embodiment, for performing each bingo game, six lottery balls 1*b* are sequentially discharged from the first discharger 61. As will be described later, those discharged lottery balls 1*b* are dropped into the lottery field 11 eventually. Then, each lottery ball 1*b* rolling on the field 150 enters any of the lottery pockets P of the rotating roulette section 53. In the ball-hold mode, the balls 1*b* are retained by the roulette section 53, so that players can easily confirm which pockets P where the balls 1*b* have entered.

The host controller 40 (lottery result decider) decides the lottery result depending on which lottery pockets P where six lottery balls 1*b* used in each single bingo game have entered. Details are as follows. As described above, the lottery pockets P correspond to numbers one to 25, respectively. When a lottery ball 1*b* enters any of the multiple lottery pockets P, the number on the bingo card BK of each player corresponding to the lottery pocket P that have accepted the ball becomes effective, i.e., filled. The host controller 40 determines that the "bingo" has been realized if five effective (filled) numbers are aligned straight in a vertical, horizontal, or diagonal direction on the bingo card BK.

Once a single bingo game is finished, the host controller 40 controls the rotation mechanism 55 to stop the roulette section 53, and selects the ball-through mode. The order of stopping the roulette section 53 and selecting the ball-through mode is not limited, and they may be executed simultaneously.

In the ball-through mode, the host controller 40 controls the slide motor unit 54 so that the roulette section 53 is in the ball-through status. Accordingly, the six lottery balls 1*b* having entered the lottery pockets P fall concurrently from the lottery pockets P, and are retrieved by the retrieval mechanism 70.

At this stage, the host controller 40 controls the route switcher 76 so that the route for transferring the lottery balls 1*b* sent from the retrieval mechanism 70 is the first partition line 81. The lottery balls 1*b* conveyed into the first partition line 81 are directed through the first carrying line in the carrier mechanism 80 to the first reservoir 60. Consequently, the retrieved six lottery balls 1*b* are transferred to the first reservoir 60 again, and used for the next bingo game. Then, when starting the next bingo game, the host controller 40 selects the ball-hold mode again, and proceeds with the above-described routine.

In this embodiment, when the bingo game is performed, it is possible to switch from the normal mode, in which the bingo game is advanced without intervention by a game facility staff member, etc., to the dealer mode, in which the game facility staff member, etc., can intervene in the game. At the initial status at which players start bingo games, the host controller 40 selects the normal mode and controls the game apparatus 100 according to the normal mode.

When the game is advanced in the normal mode, the host controller 40 controls the blocking member 105 so that movement of the lottery balls 1*b* passing through the first rail 62 is not obstructed and the lottery balls are guided to the lottery field 11 (see FIG. 4). Accordingly, all lottery balls 1*b* discharged from the first discharger 61 are directed to the lottery field 11. In this embodiment, in both of the normal mode and the dealer mode, the discharge time point at which a lottery ball 1*b* is discharged from the first discharger 61 depends on a predetermined rule. Therefore, in the normal mode, the input time point at which a lottery ball 1*b* discharged from the first discharger 61 is input to the lottery field 11 (the time point at which the lottery ball 1*b* begins to roll on the lottery field 11) depends on the predetermined rule.

The predetermined rule in the normal mode may be different from that in the dealer mode. In the normal mode, six lottery balls 1*b* are discharged from the first discharger 61 such that the six lottery balls 1*b* are sequentially input into the lottery field 11 at predetermined time intervals. For example, it is possible to utilize a rule according to which after a preceding lottery ball 1*b* enters any one of the lottery pockets P, the next lottery ball 1*b* is input to the lottery field 11. Alternatively, this rule is complied with until four preceding lottery balls 1*b* enter the lottery pockets P, and another rule is complied with for the remaining two lottery balls 1*b* in which the remaining two lottery balls 1*b* are discharged to be input into the lottery field 11 without intervals, so that the two lottery balls 1*b* are on the lottery field 11. Alternatively, the time intervals between the former and later lottery balls 1*b* among the six lottery balls 1*b* to be input to the lottery field 11 may be decided randomly.

On the other hand, in the dealer mode, the host controller 40 cannot recognize the time point at which the game facility staff member throws each lottery ball 1*b* reserved in the second reservoir 118 onto the lottery field 11 by hand. Accordingly, it is preferable to use a rule according to which after a preceding lottery ball 1*b* enters any one of the lottery pockets P, the next lottery ball 1*b* is discharged. Alternatively, it is possible to provide a sensor that detects whether or not a lottery ball 1*b* is located in the second reservoir 118, and it is possible to use a rule according to which if the sensor detects that a lottery ball 1*b* stored in the second reservoir 118 is taken out by the game facility staff member, the next lottery ball 1*b* is discharged.

When a bingo game is performed with the use of the normal mode, if a predetermined requirement is satisfied, the host controller 40 (mode setter) switches the ball lottery apparatus into the dealer mode directly after finishing the bingo game having been performed (i.e., directly after the decision of the lottery result). Thus, switching from the normal mode to the dealer mode is executed seamlessly. More specifically, when a bingo game is performed with the use of the normal mode, if the host controller 40 detects acceptance of a switching manipulation by a game facility staff member at the manipulation acceptor 201 of the dealer station 200 for switching to the dealer mode, the host controller 40 selects the dealer mode directly after finishing the bingo game having been performed, and controls the game apparatus 100 according to the dealer mode. In this embodiment, a game facility staff member at the dealer station 200 conducts switching manipulation by pushing a manipulation button 202, i.e., switches from the normal mode to the dealer mode. The predetermined requirement can be set optionally. For example, at a predetermined time, the host controller 40 may select the dealer mode directly after finishing the bingo game.

A cancelling function for breaking off the dealer mode and for reinstating the normal mode may be added to the game apparatus 100. If the dealer mode is canceled, the next and following lottery balls 1*b* are input to the lottery field 11 in accordance with the predetermined rule for the normal mode.

In the dealer mode, the host controller 40 controls the position of the blocking member 105 such that the movement of lottery balls 1*b* passing through the first rail 62 is blocked to prevent the lottery balls 1*b* from being guided to the lottery field 11 (see FIG. 5). Accordingly, all lottery balls 1*b* discharged from the first discharger 61 are held in the second reservoir 118.

In this embodiment, when a bingo game is performed with the use of the dealer mode, a game facility staff member in the dealer station 200 takes out the lottery balls 1*b* stored in the second reservoir 118 (of which the movement is blocked), and throws them on the lottery field 11. Consequently, the input time point at which a lottery ball 1*b* is thrown on the lottery field 11 depends on the throw-in activity of the ball by the game facility staff member. At this time, the game facility staff member may throw the lottery balls 1*b* stored in the second reservoir 118 sequentially at preferable time points with spoken encouragement using a microphone, etc., so as to excite people in the game arcade. Information on the progress of the game collected from each station 20 (the number of bets by each player, the number of wins of each player, the number of a pocket that is desired to accept a ball for a player, and so on) is shown on an display device (not shown) at the dealer station 200, and the spoken encouragement using a microphone may be based on the information.

As has been described above, in this embodiment, in the dealer mode, a game facility staff member can decide input time points of the lottery balls 1*b*, and can freely adjust the time of the spoken encouragement using a microphone, so that excitement can be effectively produced. Furthermore, the time point at which the event (spoken encouragement using a microphone) can be varied depending on the characteristics and the number of players in the game arcade, so that the game facility staff member can switch seamlessly from the normal mode to the dealer mode at the member's desired time point in conformance with the state in the game arcade. In addition, after finishing the dealer mode, continuous transition to the normal mode may be conducted. In conformance with the state in the game arcade, it is possible for the game arcade manager to govern events optionally, for example, a whole single bingo game may be advanced with the use of the dealer mode, or multiple bingo games may be performed with the use of the dealer mode.

In this embodiment, when the bingo game is played, the host controller 40 executes a time-out abnormality decision in which the host controller 40 determines that a time-out abnormality has occurred if no lottery ball 1*b* has entered any of the multiple lottery pockets P within a predetermined decision period after discharging a lottery ball 1*b* from the first discharger 61. As described above, whereas lottery balls 1*b* discharged from the first discharger 61 are directly guided to the lottery field 11 in the normal mode, lottery balls 1*b* discharged from the first discharger 61 are reserved in the second reservoir 118 and then thrown onto the lottery field 11 by the game facility staff member in the dealer mode. Therefore, in the dealer mode, the time length from discharging a lottery ball 1*b* from the first discharger 61 to the entry of the lottery ball 1*b* into one of the multiple lottery pockets P is longer than that in the normal mode. Accordingly, if the decision period for the time-out abnormality decision in the dealer mode is the same as that in the normal mode, the progress of the game is blocked in the dealer mode by the decision that a time-out abnormality has occurred. In this embodiment, the decision period for the time-out abnormality decision in the dealer mode is set longer than that in the normal mode, so as to restrict occurrence of errors in the dealer mode. Since an unnecessary time-out abnormality is not decided, the game can be advanced properly.

Aspects of the special game will be described. If a predetermined requirement is satisfied in a bingo game, the host controller 40 starts executing the special game directly after finishing the bingo game having been performed. The predetermined requirement is optional. For example, if a number in bingo for a player exceeds a predetermined number, the special game may be started.

When performing the special game, the host controller 40 selects the ball-through mode, and controls the retention plate 52 so that the roulette section 53 is in the ball-through status. In this status, the host controller 40 controls the rotation mechanism 55 to rotate the roulette section 53, and controls the second discharger 64 to discharge sequentially a plurality of (for example, 70) lottery balls 1*b* reserved in the special game reservoir 63. The lottery balls 1*b* discharged from the second discharger 64 are directed to the field 150 at predetermined time intervals through the spiral second rail 65. Then, the lottery balls 1*b* rolling on the field 150 enters any of the lottery pockets P in the rotating roulette section 53.

In the special game, when a lottery ball 1*b* enters one of the multiple lottery pockets P, token coins of which the number is the same as the number corresponding to the lottery pocket P where the lottery ball 1*b* entered are paid out to the player. In this embodiment, when lottery balls 1*b* enter all of the lottery pockets P, the host controller 40 decides that the requirement for a "special prize" is satisfied and pays out a large number of token coins (for example, 1,000 token coins) to the player. Instead of token coins, coupons or vouchers may be paid out.

When the special game is performed, the roulette section 53 is set to the ball-through status, so that lottery balls 1*b* having entered the lottery pockets P fall through holes H positioned under the lottery pockets P and are retrieved by the retrieval mechanism 70. In this stage, the host controller 40 controls the route switcher 76 so that the route for transferring the lottery balls 1*b* sent from the retrieval mechanism 70 is the second partition line 82. The lottery balls 1*b* conveyed into the second partition line 82 are directed through the second carrying line in the carrier mechanism 80 to the special game reservoir 63. Consequently, the retrieved lottery balls 1*b* are transferred to the special game reservoir 63, and are discharged sequentially from the second discharger 64 again. In this embodiment, the host controller 40 finishes the special game once the second discharger 64 completes discharging 70 lottery balls 1*b*.

However, the special game may be omitted and only the bingo game may be performed in an alternative embodiment. In this alternative embodiment, structural elements used for the special game (the special game reservoir 63, the second discharger 64, the second rail 65, etc.) are unnecessary.

B. Second Embodiment

Next, a second embodiment of the present invention will be described. In the second embodiment, the above-described blocking member 105 and the second reservoir 118 are excluded, so that all of the lottery balls 1*b* passing through the first rail 62 are directed to the lottery field 11. In addition, the second embodiment is different from the first embodiment in that the discharge time point at which each individual lottery ball 1*b* is discharged from the first discharger 61 is decided depending on a predetermined rule in the normal mode, whereas the discharge time point depends on the time point at which the manipulation acceptor 201 of the dealer station 200 accepts human manipulation in the dealer mode. Other structures in the second embodiment are the same as those in the first embodiment, and common parts will not be described.

When a bingo game is performed with the use of the normal mode, in a manner similar to that in the first embodiment, the host controller 40 (discharge controller) controls the rotation mechanism 55 to rotate the roulette section 53, and controls the first discharger 61 to discharge multiple lottery balls 1*b* individually in compliance with the predetermined rule. Since the discharge time point at which each individual lottery ball 1*b* is discharged from the first discharger 61 depends on the predetermined rule, the input time point at which the lottery ball 1*b* is input to the lottery field 11 also depends on the predetermined rule. The flow of the bingo game is the same as that in the first embodiment, and will not be described.

When a bingo game is performed with the use of the dealer mode, the host controller 40 (discharge controller) controls the first discharger 61 so that the first discharger 61 discharges an individual lottery ball 1*b* in accordance with the time point at which the manipulation acceptor 201 accepts a manipulation. The discharge time point at which the first discharger 61 discharges a lottery ball 1*b* depends on the time point at which the manipulation acceptor 201 of the dealer station 200 accepts a predetermined manipulation. More specifically, in the dealer mode, when the host controller 40 detects that the manipulation acceptor 201 of the dealer station 200 accepts a manipulation that instructs discharge of a lottery ball 1*b* (in the following, this manipulation will be referred to as a "discharge instruction manipulation"), the host controller 40 controls the first discharger 61 to discharge a lottery ball 1*b*. In this embodiment, a game facility staff member in the dealer station 200 conducts the discharge instruction manipulation by pushing a predetermined manipulation button.

As described above, in the dealer mode, since the discharge time point depends on the time point at which the manipulation acceptor 201 of the dealer station 200 accepts the discharge instruction manipulation by a game facility staff member, the input time point at which the lottery ball 1*b* discharged from the first discharger 61 is input to the lottery field 11 also depends on the time point at which the manipulation acceptor 201 of the dealer station 200 accepts the discharge instruction manipulation by the game facility staff member. At this time, the game facility staff member may conduct spoken encouragement using a microphone etc., and may conduct discharge instruction manipulations to input the lottery balls 1*b* sequentially into the lottery field 11 at preferable time points in conformance with the spoken encouragement, so as to excite people in the game arcade.

In the second embodiment, in the dealer mode, a game facility staff member can decide input time points of the lottery balls 1*b*, and can freely adjust the time of the spoken encouragement using a microphone, so that excitement can be effectively produced.

C. Variations

The above-described embodiments may be modified in various different ways. Examples of specific variations are described below. Two or more variations freely selected from the below variations may be combined.

1) Variation 1

In the first embodiment, when a bingo game is performed with the use of the dealer mode, a game facility staff member in the dealer station 200 takes out the lottery balls 1*b* reserved in the second reservoir 118, and throws them on the lottery field 11. However, the person who throws the balls is not so limited. For example, a player may throw the balls. In this variation, before the bingo game in the dealer mode is started, a lottery may be conducted in order to decide a player, i.e., who will act as the dealer who throws the balls. The player who won the lottery may be guided to the dealer station 200 by a game facility staff member, and will throw the balls from the dealer station 200. The input time point at which a lottery ball 1*b* is input into the lottery field 11 depends on the throw-in activity of the ball by this player. In this variation, the bingo game is advanced with the intervention of a predetermined manipulation (ball throwing) by the player.

Alternatively, a third party who does not participate in the bingo game (for example, an audience member of the bingo game) may throw the balls. In summary, the input time point in the dealer mode is dependent on human action for taking out and for inputting the lottery ball 1*b* of which the movement is blocked onto the lottery field 11.

2) Variation 2

In the second embodiment, the input time point depends on the time point at which the manipulation acceptor 201 of the dealer station 200 accepts the discharge instruction manipulation by the game facility staff member. However, the person who conducts the discharge instruction manipulation is not so limited. For example, a player may conduct the discharge instruction manipulation. In this variation, before the bingo game in the dealer mode is started, a lottery may be conducted in order to decide which player will conduct the discharge instruction manipulation. The player who won the lottery may be guided to the dealer station 200 by a game facility staff member, and will conduct the discharge instruction manipulation at the dealer station 200 by pushing a predetermined manipulation button. The input time point depends on the time point at which the manipulation acceptor 201 of the dealer station 200 accepts the discharge instruction manipulation by the player.

Each station 20 may include the above-described manipulation acceptor 201. In this variation, the player who won the lottery may conduct the discharge instruction manipulation by pushing a predetermined manipulation button in the station at which the player plays the game. The input time point depends on the time point at which the manipulation acceptor 201 of the station 20 accepts the discharge instruction manipulation by the player.

Alternatively, a third party who does not participate in the bingo game (for example, an audience member of the bingo game) may conduct the discharge instruction manipulation. In summary, the input time point in the dealer mode is dependent on the time point at which the manipulation acceptor 201 accepts human action.

3) Variation 3

In the above-described embodiments, the host controller 40 executes the time-out abnormality decision in both the normal mode and the dealer mode, and the decision period for the time-out abnormality decision in the dealer mode is set longer than that in the normal mode. However, the present invention is not limited to the embodiments. For example, the host controller 40 may execute the time-out abnormality decision in the normal mode, and may omit to to execute the time-out abnormality decision. In this variation, time-out errors do not occur in the dealer mode, so that it is possible to reliably prevent progress of the game from being interrupted by errors. However, the host controller 40 may execute abnormality decisions other than the time-out abnormality decision.

4) Variation 4

In the above-described embodiments, as a human intervention in the ball lottery in the dealer mode, a human, such as a game facility staff member, inputs the lottery balls 1*b*. Furthermore, as another human intervention in the ball lottery, a human, such as a game facility staff member, may freely decide the rotation speed of the roulette section 53. More specifically, in this variation, the mode setter (host controller 40) of the ball lottery apparatus 10 can set the ball lottery apparatus 10 to a third mode (normal mode) in which the rotation speed of the roulette section 53 is in compliance with a predetermined rule, and to a fourth mode (dealer mode) in which the rotation speed of the roulette section 53 is dependent on human action.

REFERENCE SYMBOLS

| | |
|---|---|
| 10: Ball Lottery Apparatus | 11: Lottery Field |
| 20: Station | 30: Display Unit |
| 40: Host Controller (Lottery Result Decider, Mode Setter, Discharge Controller) | |
| 50: Lottery Mechanism | 51: Roulette Wheel |
| 52: Retention Plate | 53: Roulette Section |
| 54: Slide Motor Unit | 55: Rotation Mechanism |
| 56: Shaft | 57: Motor Unit |
| 58: Timing Belt | 60: First Reservoir |
| 61: First Discharger | 62: First Rail |
| 63: Special Game Reservoir | 64: Second Discharger |
| 65: Second Rail | 70: Retrieval Mechanism |
| 76: Route Switcher | 80: Carrier Mechanism |
| 81: First Partition Line | 82: Second Partition Line |
| 90: Connection Member | 92: Slide Motor |
| 94: Screw Shaft | 96: Sliding Member |
| 100: Game Apparatus | 103: Base Member |
| 105: Blocking Member | 118: Second Reservoir |
| 150: Field | 201: Manipulation Acceptor |
| lb: Lottery Ball | F: Rib |
| H: Hole | Ph: Through-Hole |
| P: Lottery Pocket (Hole) | |

The invention claimed is:

1. A ball lottery apparatus comprising:

a lottery field including multiple holes in which multiple lottery balls enter;

a discharger configured to discharge individually the multiple lottery balls into the lottery field, the discharger located separate from the lottery field;

a lottery result decider configured to decide a lottery result depending on which lottery holes the lottery balls have entered;

a retrieval mechanism configured to retrieve the lottery balls that have entered the holes;

a mode setter configured to set the ball lottery apparatus to a first mode in which an input time point at which each of the lottery balls discharged from the discharger is input to the lottery field depends on a predetermined rule, and to a second mode in which the input time point depends on human action;

a rail connected to the discharger to guide the lottery balls discharged from the discharger to the lottery field; and a blocking member provided in the rail at a location between the discharger and an entrance of the lottery field, wherein the blocking member comprises a movable plate, which permits the lottery balls from the discharger to enter into the lottery field in the first mode, and blocks the lottery balls from the discharger before the lottery balls enter any of the multiple holes in the lottery field in the second mode.

2. The ball lottery apparatus according to claim 1, further comprising:

a discharge controller configured to control a discharge time point at which each of the lottery balls are discharged from the discharger, wherein the blocking member is configured to permit the lottery balls to pass through the rail to be guided to the lottery field in the first mode, and block the lottery balls from passing through the rail and prevent the lottery balls from being guided to the lottery field in the second mode.

3. The ball lottery apparatus according to claim 2, wherein the lottery balls passing through the rail are blocked and are prevented from being guided to the lottery field before the lottery balls enter the lottery field.

4. The ball lottery apparatus according to claim 2, wherein the blocking member permits the lottery balls, after the lottery balls are discharged from the discharger, to pass through the rail to enter the lottery fields in the first mode, and in the second mode, blocks the lottery balls from entering the lottery field, after the lottery balls are discharged from the discharger and are passing through the rail, but before the lottery balls enter the lottery field.

5. The ball lottery apparatus according to claim 1, further comprising:

a manipulation acceptor configured to accept the human action, wherein the mode setter comprising a discharge controller configured to control a discharge time point at which each of the lottery balls are discharged from the discharger, and wherein the discharge controller is configured to control the discharge time point depending on the predetermined rule in the first mode, and to control the discharge time point depending on a time point at which the manipulation acceptor accepts the human action in the second mode.

6. The ball lottery apparatus according to claim 1, further comprising:

an abnormality detector configure to determine that an abnormality has occurred if no lottery ball has entered any of the multiple holes within a predetermined decision period after discharging a lottery ball from the discharger, wherein the predetermined decision period in the second mode is set longer than that in the first mode.

7. The ball lottery apparatus according to claim 1, further comprising:

an abnormality detector configured to execute an abnormality decision for determining that an abnormality has occurred if no lottery ball has entered any of the multiple holes within a predetermined decision period after discharging a lottery ball from the discharger, wherein the abnormality detector is configured to execute the abnormality decision in the first mode and for not executing the abnormality decision in the second mode.

8. The ball lottery apparatus according to claim 1, wherein if a predetermined requirement is satisfied in the first mode, the mode setter is configured to switch the ball lottery apparatus to the second mode directly after finishing the decision of the lottery result made by the lottery result decider in the first mode.

9. The ball lottery apparatus according to claim 1, wherein in the first mode, the blocking member permits the lottery balls, after the lottery balls are discharged from the discharger, to enter the lottery field, and in the second mode blocks the lottery balls from entering the lottery field, after the lottery balls are discharged from the discharger, but before the lottery balls enter the lottery field.

* * * * *